US008442417B2

(12) United States Patent
Abe et al.

(10) Patent No.: US 8,442,417 B2
(45) **Date of Patent: *May 14, 2013**

(54) BEARING DEVICE, DRUM UNIT, AND IMAGE FORMING APPARATUS

(75) Inventors: Koji Abe, Aichi (JP); Junichi Hashimoto, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/465,152

(22) Filed: May 7, 2012

(65) Prior Publication Data

US 2012/0219322 A1 Aug. 30, 2012

Related U.S. Application Data

(63) Continuation of application No. 12/732,327, filed on Mar. 26, 2010, now Pat. No. 8,200,122.

(30) Foreign Application Priority Data

Sep. 16, 2009 (JP) ..... 2009-214501

(51) Int. Cl.
*G03G 15/00* (2006.01)
*G03G 15/01* (2006.01)
*G03G 21/18* (2006.01)

(52) U.S. Cl.
USPC ..... 399/117; 399/122; 399/159

(58) Field of Classification Search ..... 399/111, 399/112, 116, 117, 122, 159
See application file for complete search history.

(56) References Cited

U.S. PATENT DOCUMENTS

| | | | | |
|---|---|---|---|---|
| 6,002,897 | A | 12/1999 | Kohno et al. | 399/117 |
| 6,530,692 | B2 | 3/2003 | Wyer | 384/295 |
| 8,200,122 | B2 * | 6/2012 | Abe et al. | 399/117 |
| 2007/0036582 | A1 | 2/2007 | Okabe | 399/111 |
| 2010/0135697 | A1 | 6/2010 | Hashimoto | 399/117 |

FOREIGN PATENT DOCUMENTS

| | | | |
|---|---|---|---|
| JP | HEI 03-281370 | | 12/1991 |
| JP | HEI 05-180217 | | 7/1993 |
| JP | HEI 10-184663 | A | 7/1998 |
| JP | HEI 11-024504 | | 1/1999 |
| JP | 2003-066665 | | 3/2003 |
| JP | 2007-72422 | A | 3/2007 |
| JP | 2008-94529 | A | 4/2008 |
| JP | 2008-95761 | A | 4/2008 |

OTHER PUBLICATIONS

Notification of Reasons for Rejection dated Jul. 26, 2011 received from the Japanese Patent Office from related Japanese Application No. 2009-214501, together with an English-language translation.
Official Action dated Oct. 24, 2011 from related U.S. Appl. No. 12/732,327.
Chinese Official Action dated Mar. 6, 2013 from related Application No. 201010157054.0 together with an English language translation.

* cited by examiner

*Primary Examiner* — Sophia S Chen
(74) *Attorney, Agent, or Firm* — Scully, Scott, Murphy & Presser, PC

(57) ABSTRACT

A bearing device to hold a rotor in an opening formed in a frame is provided. Circumference of the opening is formed to have a first edge and a second edge, which linearly extend along different directions from each other. The bearing device includes a flange member to be attached to an axial end portion of the rotor, a bearing member to be externally attached to the flange member and inserted in the opening, and a presser member to press the flange member toward a section between the first edge and the second edge.

17 Claims, 10 Drawing Sheets

BEARING DEVICE, DRUM UNIT, AND IMAGE FORMING APPARATUS

CROSS REFERENCE TO RELATED APPLICATION

This application is a continuation application of U.S. Ser. No. 12/732,327 filed on Mar. 26, 2010 and claims priority from Japanese Patent Application No. 2009-214501, filed on Sep. 16, 2009, the entire contents of each of which is incorporated herein by reference.

BACKGROUND

1. Technical Field

An aspect of the present invention relates to a bearing device, a drum unit, and an image forming apparatus.

2. Related Art

A tandem-typed image forming apparatus having an image forming unit to form an image on a recording medium in, for example, an electrophotographic method is known. The image forming apparatus may be equipped with a plurality of photosensitive drums, each of which is capable of forming an image in a different color, are arranged in line. For example, a tandem-typed color printer having four photosensitive drums, which are integrally attachable in and detachable from a casing of a body of the printer, is known.

Such a printer may be equipped with drum subunits to support the photosensitive drums respectively and a pair of side frames to hold the drum subunits at axial end portions thereof. The side frames are configured to further hold detachable developer cartridges, each of which includes a developer roller corresponding to one of the drum subunits. Thus, the drum subunits, the developer cartridges, and the pair of side frames consist of a drum unit to be detachably installed the casing of the printer.

A structure to hold the photosensitive drums by the pair of side frames may be, for example, such that each photosensitive drum is provided with flanges at axial end portions thereof, and the flanges are rotatably inserted in bearings, which are fixed to through holes formed in the side frames. Thus, the flanges are rotatable with respect to the bearings and the side frames.

SUMMARY

In the above structure, however, it is assumed that thermal expansion may occur between the side frames, and the photosensitive drums may be misaligned with respect to recording medium or other components in the printer due to the thermal deformation. In order to avoid such misalignment, the through holes to receive the flanges are required to have a certain amount of allowance to absorb the thermal deformation. Therefore, it is difficult to set the photosensitive drums in correct positions with respect to the frames.

In view of the above difficulty, the present invention is advantageous in that a bearing device, a drum unit, and an image forming apparatus, in which a rotor such as the photosensitive drum is set in a correct position with respect to a frame assembly, are provided.

According to an aspect of the present invention, a bearing device to hold a rotor in an opening formed in a frame is provided. Circumference of the opening is formed to have a first edge and a second edge, which linearly extend along different directions from each other. The bearing device includes a flange member to be attached to an axial end portion of the rotor, a bearing member to be externally attached to the flange member and inserted in the opening, and a presser member to press the flange member toward a section between the first edge and the second edge.

According to another aspect of the present invention, a drum unit is provided. The drum unit includes a rotatable photosensitive drum, a flange member to be attached to an axial end portion of the photosensitive drum, a frame having an opening formed to have circumference including a first edge and a second edge, which linearly extend along different directions from each other, a bearing member to be externally attached to the flange member and inserted in the opening, and a presser member to press the flange member toward a section between the first edge and the second edge.

According to an aspect of the present invention, an image forming apparatus is provided. The image forming apparatus includes a rotatable photosensitive drum, a flange member to be attached to an axial end portion of the photosensitive drum, a frame having an opening formed to have circumference including a first edge and a second edge, which linearly extend along different directions from each other, a bearing member to be externally attached to the flange member and inserted in the opening, and a presser member to press the flange member toward a section between the first edge and the second edge.

BRIEF DESCRIPTION OF THE ACCOMPANYING DRAWINGS

DETAILED DESCRIPTION

Hereinafter, an embodiment according to the present invention will be described with reference to the accompanying drawings.

1. Printer

An overall configuration of a printer 1 according to the present embodiment will be described. The printer 1 is a tandem-typed image forming apparatus. The printer 1 has a casing 2, and a drum unit 3 attached to the casing 2. The drum unit 3 is attachable to and detachable from the casing 2 through an opening (not shown) which is in front of the printer 1 and covered, when the printer 1 is in use, by a front cover 4.

Figure 1:
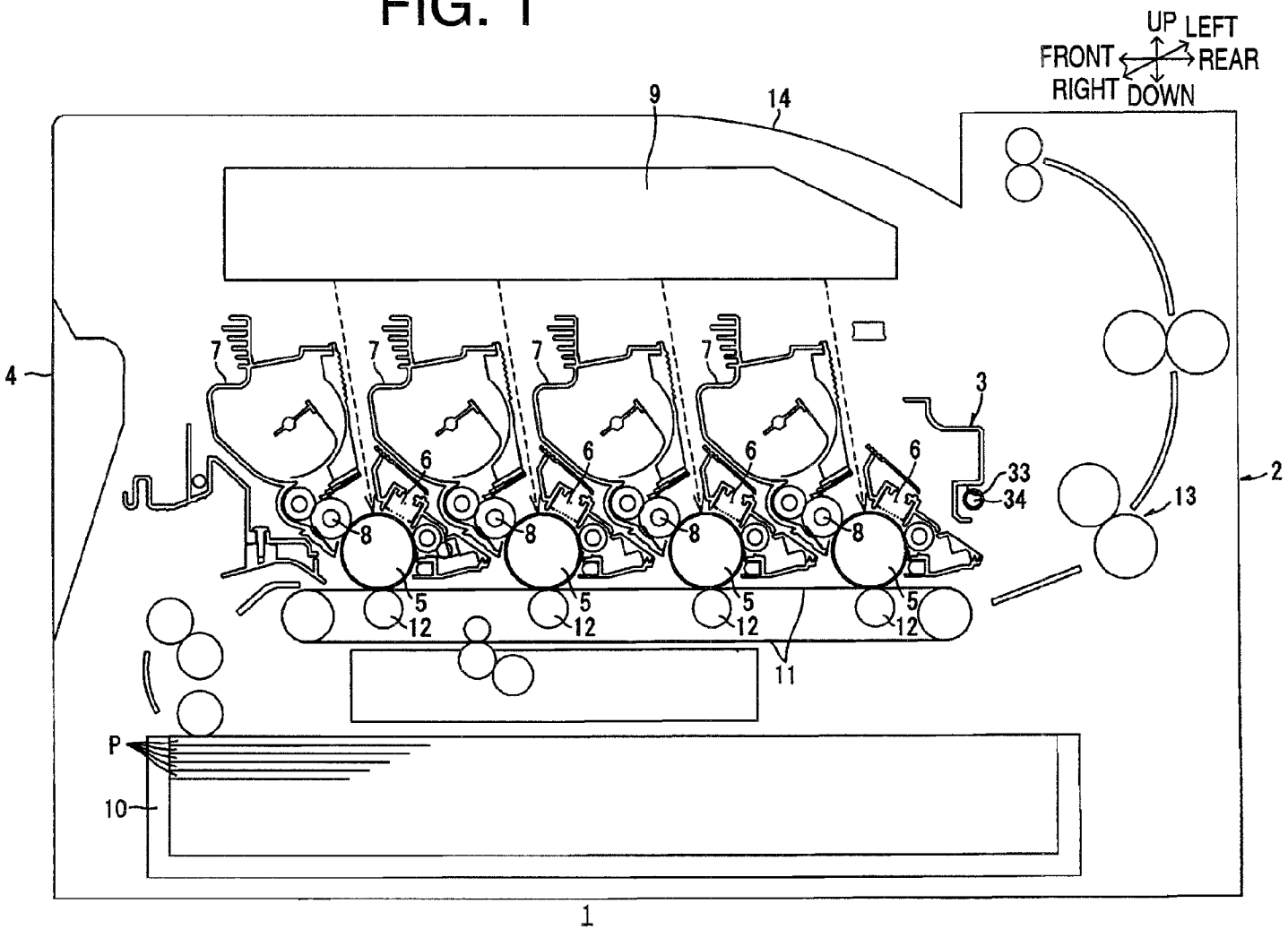
FIG. 1 is a cross-sectional side view of a printer according to an embodiment of the present invention.

In the present embodiment, directions concerning the printer 1 will be referred to in accordance with the orientation of the printer 1 shown in FIG. 1. A left-hand side in FIG. 1, on which the cover 4 is provided, is referred to as front, and a right-hand side, which is opposite from the cover 4, is referred to as rear. Further, a right-left direction of the printer 1 refers to a direction perpendicular to the cross-section of the printer 1 in FIG. 1, and is also referred to as a widthwise direction.

The drum unit 3 includes four rotatable photosensitive drums 5. The four photosensitive drums 5 being rotors are provided in order to form an image in colors of black (K), yellow (Y), magenta (M), and cyan (C), respectively. In the present embodiment, the photosensitive drums 5 for black, yellow, magenta, and cyan are aligned in the given order to be equally spaced in line in the front-rear direction of the printer 1.

The drum unit 3 is provided with four scorotoron chargers 6 and four developer cartridges 7, each of which corresponds to one of the photosensitive drums 5. Each developer cartridge 7 includes a developer roller 8, which supplies developer agent (i.e., toner) to the photosensitive drum 5. The developer cartridges 7 are attachable to and detachable from the drum unit 3. The printer 1 is provided with an exposure unit 9, which emits four laser beams, each of which corresponds to one of the CMYK colors of the photosensitive drum 5, in a position above the drum unit 3.

As the photosensitive drum 5 rotates, a surface of the photosensitive drum 5 is charged by the scorotoron charger 6 and exposed to the laser bean that selectively scans the surface of the photosensitive drum 5 according to image data. Thus, the electric charges are removed from the surface of the photosensitive drum 5 by the laser beam, and a latent image is formed on the surface of the photosensitive drum 5. When the photosensitive drum 5 further rotates and the latent image on surface of the photosensitive drum 5 becomes in contact with a surface of the developer roller 8, the toner adhered on the surface the developer roller 8 is supplied to the latent image on the photosensitive drum 5. Accordingly, a toner image is formed on the surface of the photosensitive drum 5.

In the printer 1, the exposure unit 9 may be replaced with four LED arrays, each of which corresponds to one of the photosensitive drums 5.

The printer 1 includes a sheet cassette 10 to contain sheets of recording paper P at a bottom portion of the casing 2. The recording sheets P in the sheet cassette 10 are fed by rollers one by one to a conveyer belt 11 being an endless belt. The conveyer belt 11 is arranged in the casing 2 in a position to have an upper and outer surface thereof opposing to lower portions of the four photosensitive drums 5. Further, an upper and inner surface of the conveyer belt 11 is opposed to transfer rollers 12, which are in positions to oppose to the photosensitive drums 5 respectively via the upper portion of the conveyer belt 8. The recording sheet P carried to the conveyer belt 11 is fed in between the conveyer belt 11 and the photosensitive drums 5 sequentially by circulation of the conveyer belt 11. Thus, the toner images formed on the surface of the photosensitive drums 5 are transferred to the recording sheet P by a predetermined level of transfer bias applied to the transfer rollers 12.

The recording sheet P with the transferred colored images is conveyed to a fixing unit 13, in which the colored images are thermally and by pressure fixed to the surface of the recording sheet P. The recording sheet P is thereafter carried by rollers and discharged in a discharge tray 14, which is on top of the casing 2 of the printer 1.

2. Drum Unit

Figure 2:
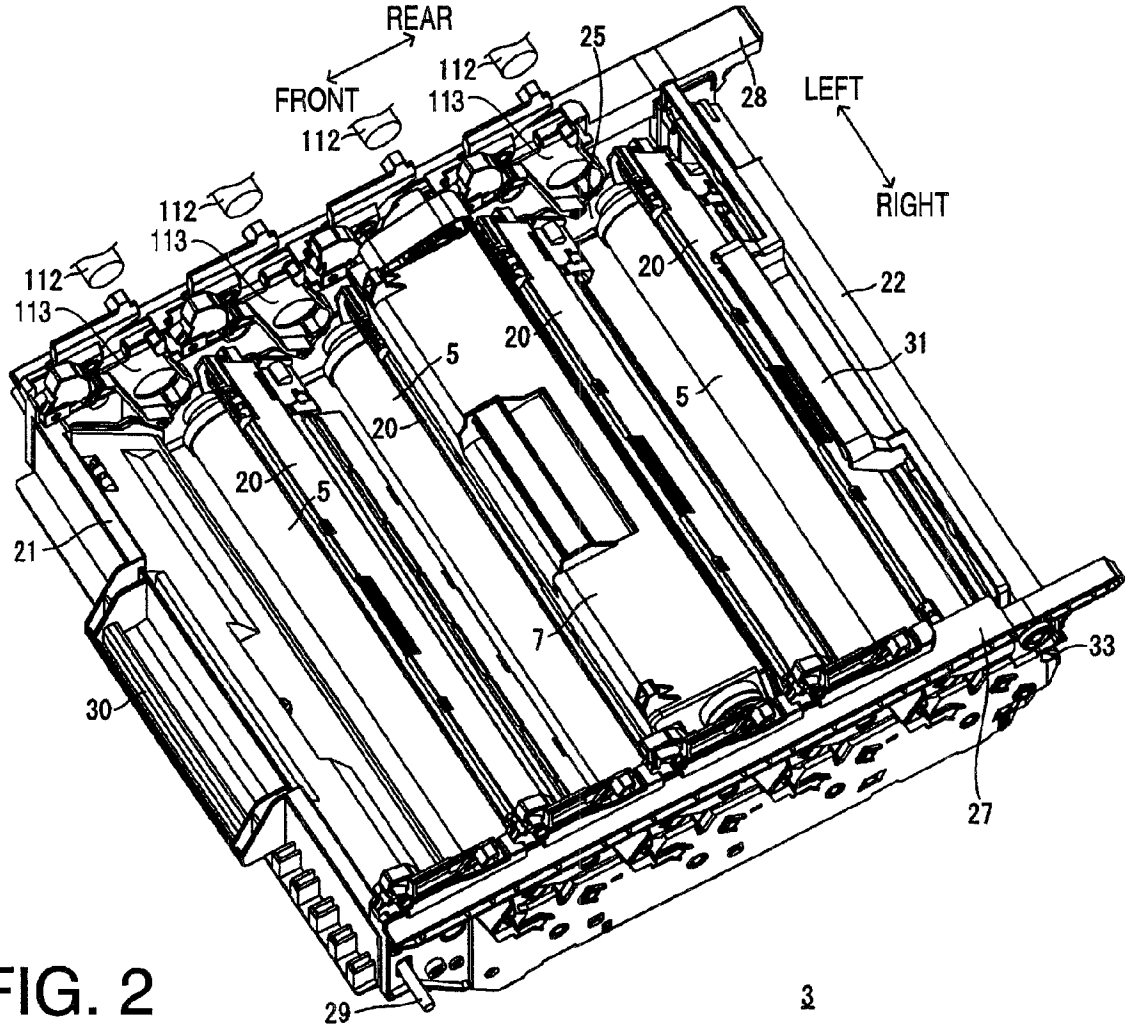
FIG. 2 is a perspective view of a drum unit with one developer cartridge attached in the printer according to the embodiment of the present invention.

Next, the drum unit 3 will be described with reference to FIG. 2. The drum unit 3 includes the four photosensitive drums 5, the four developer cartridges 7, four drum subunit 20, a front beam 21, a rear beam 22, a frame assembly including a right inner plate 24 (see FIG. 3), a left inner plate 25, a right outer plate 27, and a left outer plate 28. The drum unit 3 including these components is detachably attached to the casing 2 of the printer 1.

2.1 Drum Subunits

The drum subunits 20 are arranged in line in the front-rear direction to be spaced from one another in between the right inner plate 24 and the left inner plate 25. Each of the drum subunits 20 is made of resin and formed in a shape of triangular prism, which is elongated in the left-right direction, with its lower front side being open. The drum subunit 20 includes the scorotoron charger 6 (see FIG. 1) and a cleaner member (not shown) to clean the surface of the photosensitive drum 5.

2.2 Front Beam

The front beam 21 of the drum subunit 3 is made of resin and spans a front end range between the right inner plate 24 and the left inner plate 25 being a pair. The front beam 21 includes a shaft 29, which penetrates the front beam 21 and extends in the right-left direction. Further, the shaft 29 penetrates the right inner plate 24, the left inner plate 25, the right outer plate 27, and the left outer plate 28 to protrude outward from the right outer plate 27 and the left outer plate 28. The front beam 21 is provided in a widthwise center of a top edge thereof with a front gripper handle 30, which is formed integrally with the front beam 21 and has a shape of open-top box with three sides in a plane view when viewed from top. The front gripper handle 30 is in connection with the front beam 21 at its free ends.

2.3 Rear Beam

The rear beam 22 is made of resin and spans a rear end range between the pair of the right inner plate 24 and the left inner plate 25. The rear beam 22 is provided in a widthwise center of a top edge thereof with a rear gripper handle 31, which is formed integrally with the rear beam 22 and has a shape of vertically turned U when viewed from rear. The rear gripper handle 31 is in connection with the rear beam 22 at its free ends of U and hangs over toward the upper front from the rear beam 22.

2.4 Inner Plates

Figure 3:
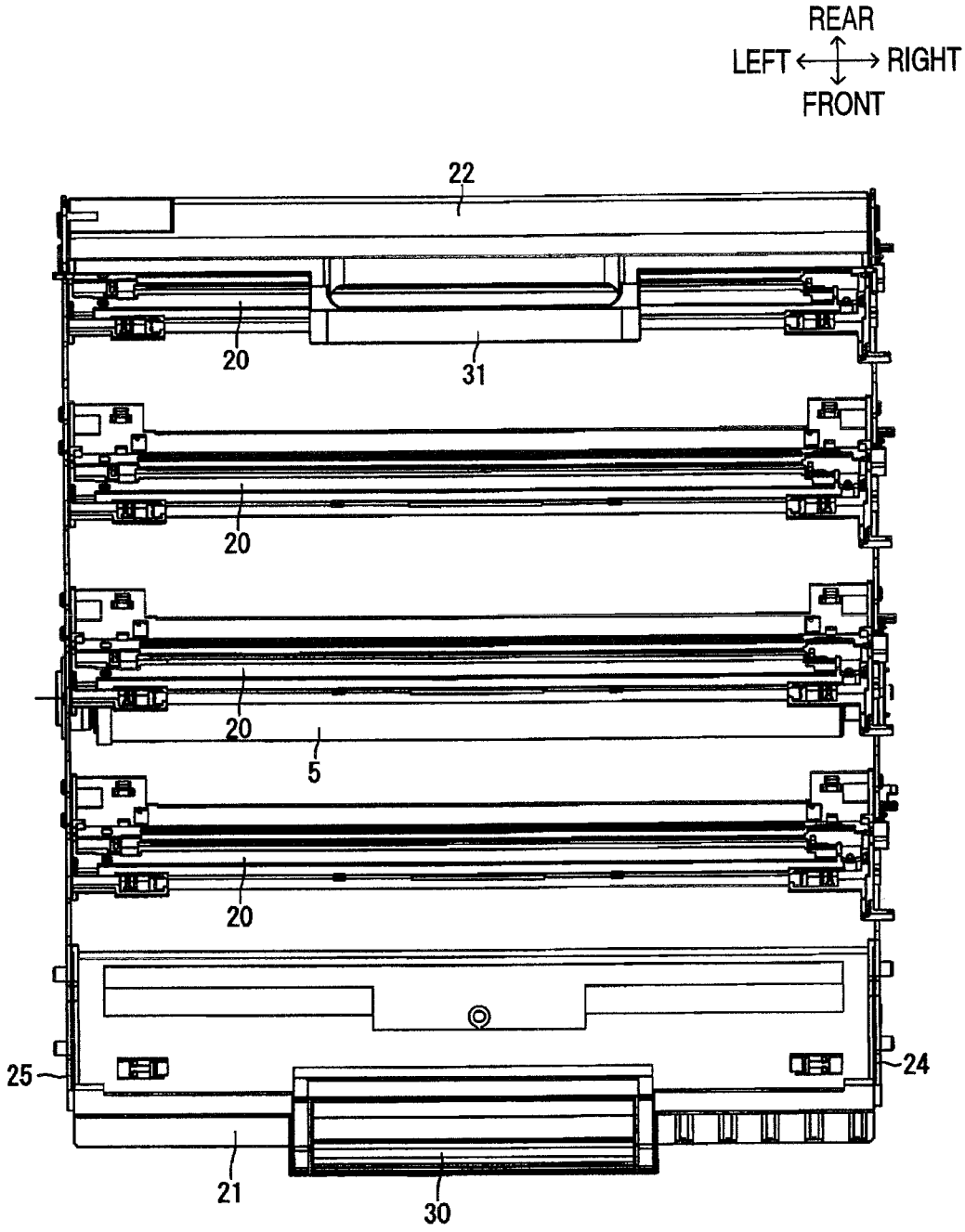
FIG. 3 is a plane view of the drum unit with a pair of outer plates removed therefrom according to the embodiment of the present invention.
Figure 4:
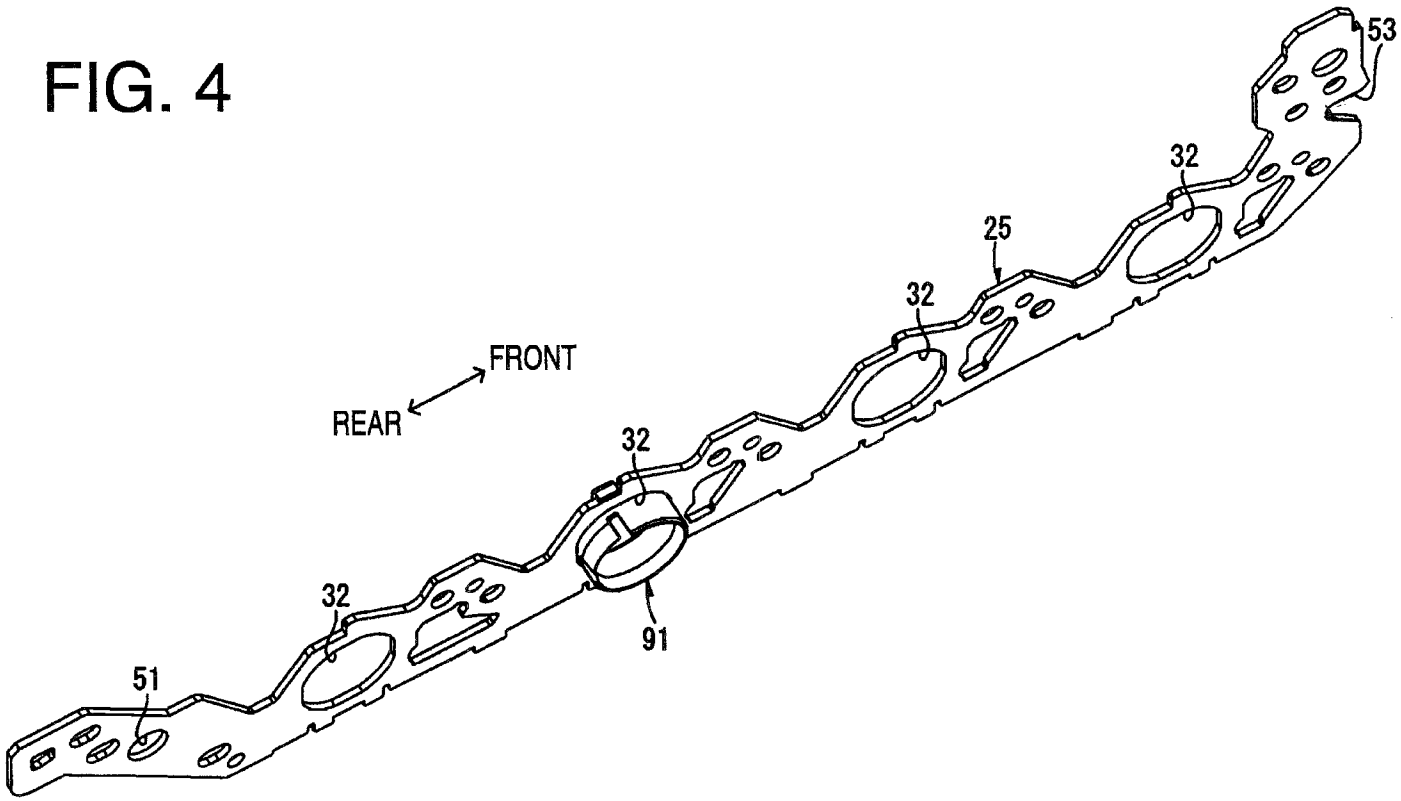
FIG. 4 is a perspective view of a left inner plate according to the embodiment of the present invention.

The right inner plate 24 and the left inner plate 25 will be described with reference to FIGS. 3 and 4. The right inner plate 24 and the left inner plate 25 are identically press-formed metal plate having a same shape. Therefore, description of the right and left inner plates 24, 25 is represented by that of the left inner plate 25.

The left inner plate 25 is an elongated plate which extends in the front-rear direction. A front end portion and a rear end portion of the left inner plate 25 are, when assembled in the drum unit 3, to oppose orthogonally to the front beam 21 and the rear beam 22 respectively. The front end portion of the left inner plate is angled to extend toward upper front. The front end portion is formed to have a shaft hole 51, through which the shaft 29 penetrates.

The rear end portion of the left inner plate 25 is angled to extend upwardly. The rear end portion is formed to have a cutout 53, which is an approximate shape of laid V, at a rear ridge thereof. The cutout 53 becomes in contact with a top-front portion of a reference shaft 34 (see FIG. 1), which extends in the widthwise direction in the casing 2, to receive the reference shaft 34 when the drum unit 3 is installed in the casing 2.

2.4.1 Drum Holes

The left inner plate 25 is formed to have four drum holes 32, which are openings aligned along the front-rear direction in evenly-spaced positions. The drum hole 32 will be described with reference to FIG. 5.

The drum hole 32 is formed to penetrate the right inner plate 24 and the left inner late 25 and formed to have four linear sections 60 and four curve sections 61. The linear sections 60 includes two vertical linear sections 63, which extends vertically and oppose to each other, and two horizontal linear sections 64, which extends horizontally and oppose to each other. One of the vertical linear section 63 closer to the rear corresponds to a first edge, which defines a horizontal position of a flange piece 81 (see FIG. 6) of the photosensitive drum 5. A lower one of the horizontal linear section 64 corresponds to a second edge, which defines a vertical position of the flange piece 81.

The four curve sections 61 connect the two opposing linear sections 60 and are formed to curve radially outward. The drum hole 32 with the linear sections 60 and the curve sections 61 is therefore in a shape of an approximate square with round corners when viewed from side.

2.4.2 Engaging Grooves

Engaging grooves in the left inner plate 25 will be described again with reference to FIG. 5. The left inner plate 25 is formed to have bearing engaging grooves 70, each of which is an approximately rectangular-shaped cutout, at a lower edge thereof in a position vertically overlapping a center of each drum hole 32. Further, a clipper-holding groove 71, which is an elongated cut out, is formed on each front and rear side of the bearing engaging groove 70 at the lower edge of the left inner plate 25.

Figure 5:
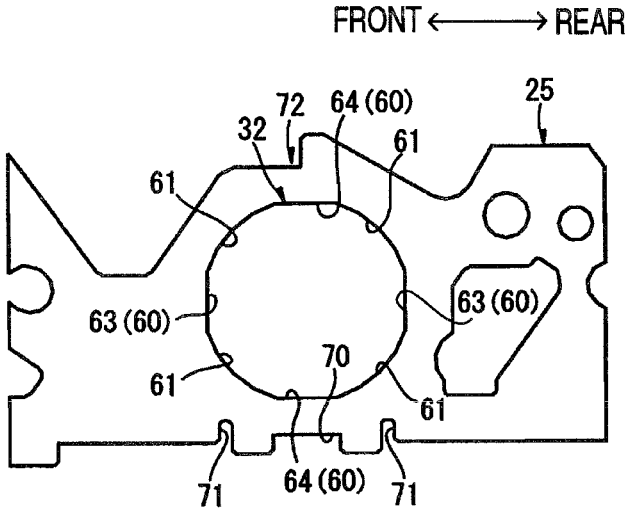
FIG. 5 is an enlarged partial view of the left inner plate according to the embodiment of the present invention.

An outline of the left inner plate 25 in a plane view at a portion above the drum hole 32 will be described with reference to FIG. 5. The upper edge of the left inner plate 25 partially inclines toward upper front and is angled downward at a position vertically overlapping a center of the corresponding drum hole 32. Further, the upper edge is again angled to extend in parallel with the horizontal linear sections 64 toward the front. As shown in FIG. 5, therefore, the upper edge of the left inner plate 25 includes a step, which defines an engageable portion 72 to be engaged with one of a first stopper 101 of a right-side bearing 90 and a second stopper 110 of a left-side bearing 91. The right and left-side bearings 90, 91 will be described later in detail.

2.5 Outer Plates

A pair of outer plates including the right outer plate 27 and the left outer plate 28 will be described again with reference to FIG. 2. The right outer plate 27 and the left outer plate 28 are made of, for example, fiber-reinforced resin. The right and left outer plates 27, 28 are formed to have, in a side view, an elongated shape being longer in the vertical direction and substantially equivalent in the front-rear direction with respect to the size of the right and left inner plates 24, 25. Front end portions and rear end portions of the right and left outer plates 27, 28 are, when assembled in the drum unit 3, to oppose orthogonally to the front beam 21 and the rear beam 22 respectively.

The front end portions of the right and left outer plates 27, 28 are formed to be smaller in the vertical direction than middle portions of the right and left outer plates 27, 28, and lower edges of the front end portions are inclined toward upper front. The rear end portions of the right and left outer plates 27, 28 are formed to be smaller in the vertical direction than the middle portions of the right and left outer plates 27, 28, and lower edges of the rear end portions are inclined toward upper rear.

Each of the rear end portions of the right and left outer plates 27, 28 is formed to have a cutout 33, which is in a substantially same shape as the cutout 53, in a position to oppose the cutout 53 of the right inner plate 24 or the left inner plate 25 along the widthwise direction. The cutouts 33 do not interfere with the reference shaft 34 when the drum unit 33 is installed in the casing 2.

2.6 Photosensitive Drums

The photosensitive drums 5 will be described with reference to FIG. 6. Each of the photosensitive drums 5 includes a cylinder 80 and a pair of flange pieces 81, which are fitted in end portions of the cylinder 80 respectively. The flange pieces 81 are not rotatable with respect to the cylinder 80.

The cylinder 80 includes a positively chargeable photosensitive outer layer. The flange pieces 81 are made of resin and are partially inserted inside the cylinder 80 from end portions of the cylinder 80. The flange piece 81 at the left end of the cylinder 80 is formed to have a connecting groove (not shown), to which a drive force transmitter 112 (see FIG. 2) is connected, in a left end surface thereof. The structure of the flange piece 81 therefore allows the photosensitive drum 5 to be rotated by the drive force transmitted by the drive force transmitter 112. The flange pieces 81 are formed to have outer diameters smaller than a diameter of the drum hole 32 formed in the right and left inner plates 24, 25.

The flange piece 81 at the right end of the cylinder 80 is rotatably supported by the right inner plate 24 through the right-side bearing 90. The flange piece 81 at the left end of the cylinder 80 is rotatably supported by the left inner plate 25 through the left-side bearing 91.

2.7 Bearings 2.7.1 Right-Side Bearings

Figure 7:
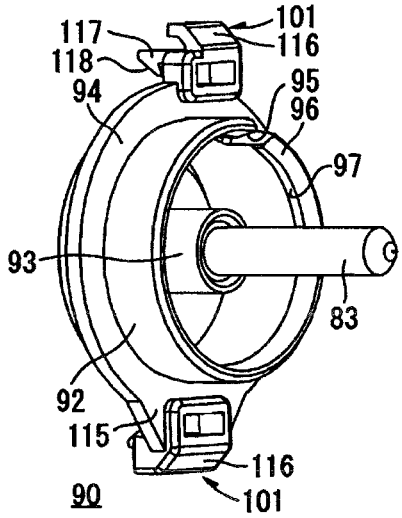
FIG. 7 is a perspective view of a right-side bearing piece according to the embodiment of the present invention.
Figure 8:
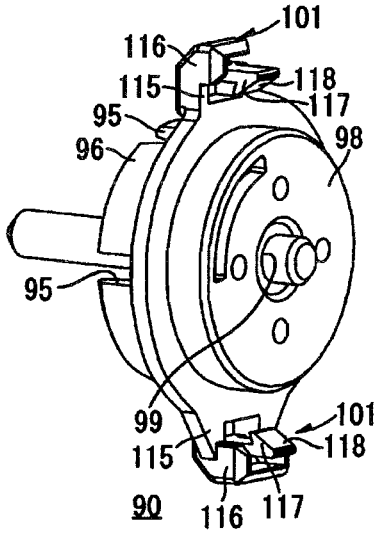
FIG. 8 is a perspective view of the right-side bearing piece according to the embodiment of the present invention.

The right-side bearings 90 will be described with reference to FIGS. 7 and 8. Each of the right-side bearings 90 is made of resin and includes a cylindrical sleeve 92, a cylindrical shaft holder 93 formed inside and coaxially with the sleeve 92, and an annular flanged part 94, which is formed to have a shape of a disk expanding from an axially midst position of an outer surface of the sleeve 92. The sleeve 92, the shaft holder 93, and the flanged part 94 are integrally formed in the right-side bearing 90.

The sleeve 92 is formed to protrude in a direction toward the right-side flange piece 81, when attached to the photosensitive drum 5, and have an outer diameter which is substantially equivalent to the inner diameter of the drum hole 32 (see FIG. 4) in the right inner plate 24. Further, an inner diameter of the sleeve 92 is substantially larger than the outer diameter of the flange piece 81 at the right. The sleeve 92 is formed to have a pair of slits 95, which are elongated along the axial direction of the sleeve 92 from the edge of the sleeve 92 to the right inner plate 24, in positions circumferentially spaced apart from each other. A smaller portion defined by the pair of slits 95 in the sleeve 92 serves to be a presser portion 96, which will be described below.

The presser portion 96 and the pair of slits 95 are set in a position between the vertical linear section 63 nearer to the front and the horizontal linear section 64 nearer to the top of the drum hole 32 of the right inner plate 24 when the right-side bearing 90 is held in the drum hole 32. In other words, when the right-side bearing 90 is held in the drum hole 32, the presser portion 96 opposes the curve section 61 between the vertical linear section 63 (i.e., the first edge) nearer to the rear and the horizontal linear section 64 (i.e., the second edge) nearer to the bottom. The presser portion 96 is formed to have a projection 97 at an edge on an inner circumference thereof.

In the present embodiment, the right-side bearing 90 can be divided into two sides by the flanged part 94, and one of the two sides is a presser side, on which the presser portion 96 is formed. The other of the two sides is a closure side, on which a closure portion 98 to plug the sleeve 92 is formed integrally with the sleeve 92. The presser side of the right-side bearing 90 mainly appears in FIG. 7, and the closure side mainly appears in FIG. 8. The closure portion 98 is formed to have an opening 99, which penetrates the closure portion 98 in the axial direction.

The opening 99 is formed in a center of the closure portion 98 to be in communication with the inner hollow defined by the shaft holder 93. The right-side bearing 90 is provided with a shaft 83, which is conductive and extends coaxially with the sleeve 92 and the shaft holder 93. The shaft 83 is inserted in the opening 99 and the shaft holder 93, and one end on the closure side extends outward from the closure portion 98. The other end of the shaft 83 on the presser side is tapered.

The flanged part 94 is formed to have two stoppers 101, in positions to oppose to each other with the shaft 83 in between, on an outer rim thereof. Each of the stoppers 101 is formed to integrally have an extended portion 115, a supporting portion 116, and a stopper projection 117. The extended portion 115 extends outward from the outer rim of the flanged part 94 and is formed to have a rectangular-shaped cutout.

The supporting portion 116 is arranged on the presser side of the extended portion 115. The stopper projection 117 is fixed on the closure side of the supporting portion 116 and extends through the cutout in the extended portion 115 to the closure side of the right-side bearing 90. The stopper projection 117 is formed to have an angled plane 118, which is angled from an edge of the stopper projection 117 toward the axis of the sleeve 92. The stopper projection 117 is formed to have a tip end of the angled plane 118, which is closer to the axis of the sleeve 92, to be apart from the closure-side surface of the flanged part 94 for an amount equivalent to thickness of the right inner plate 24 in the widthwise direction.

2.7.2 Left-Side Bearings

Figure 9:
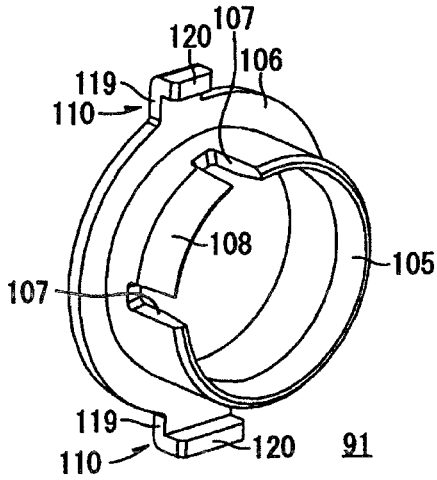
FIG. 9 is a perspective view of a left-side bearing piece according to the embodiment of the present invention.
Figure 10:
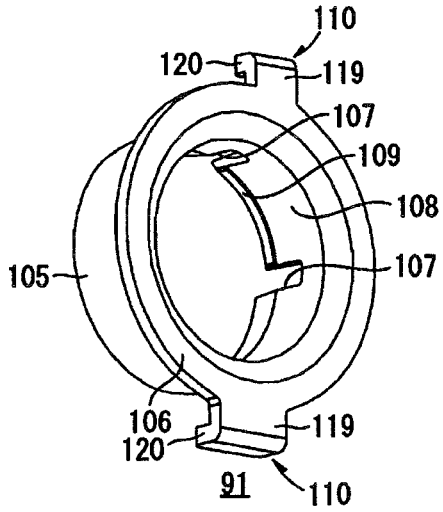
FIG. 10 is a perspective view of the left-side bearing piece according to the embodiment of the present invention.
Figure 11:
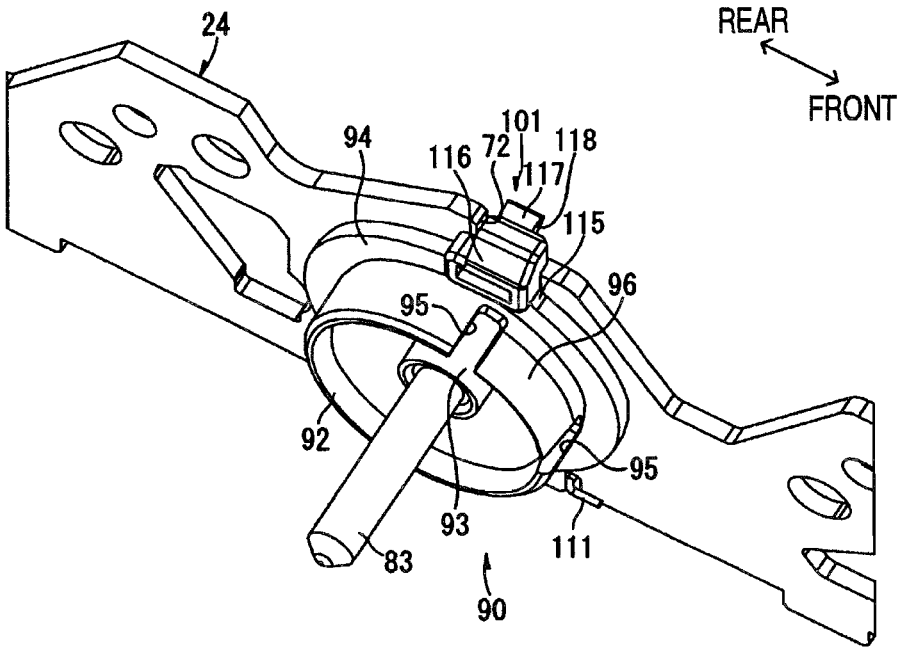
FIG. 11 is a perspective view of the right-side bearing piece set in the right inner plate according to the embodiment of the present invention.
Figure 12:
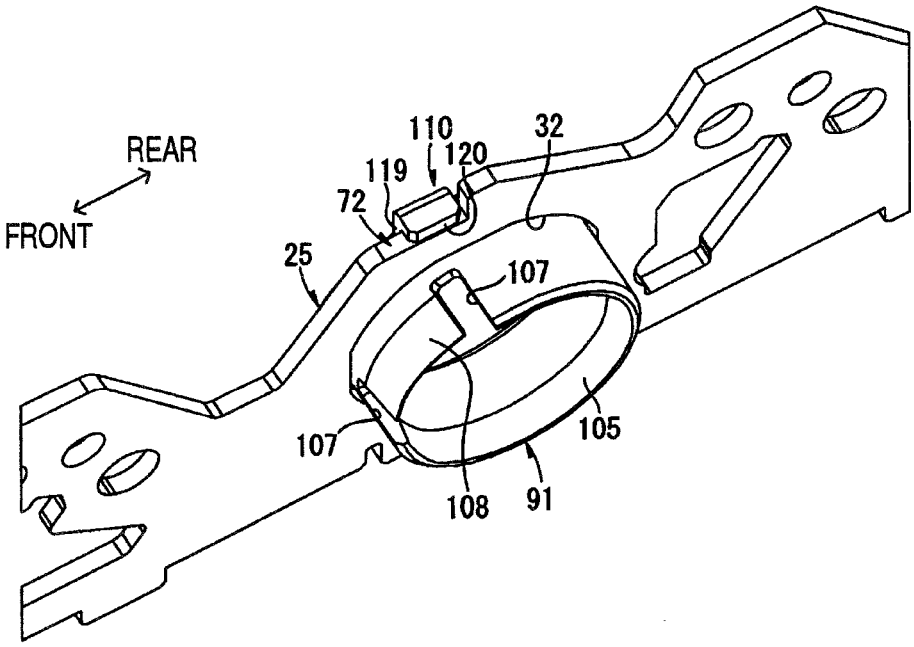
FIG. 12 is a perspective view of the left-side bearing piece set in the left inner plate according to the embodiment of the present invention.

The left-side bearings 91 will be described with reference to FIGS. 9 and 10. Each of the left-side bearings 91 is made of resin and includes a cylindrical sleeve 105 and an annular flanged part 106, which is formed to have a shape of a disk expanding from a ridge of the sleeve 105. The sleeve 105 and the flanged part 106 are integrally formed in the left-side bearing 91.

The sleeve 105 is formed to protrude in a direction toward the left-side flange piece 81, when attached to the photosensitive drum 5, have an outer diameter which is substantially equivalent to the inner diameter of the drum hole 32 (see FIG. 4) in the left inner plate 25. Further, an inner diameter of the sleeve 105 is substantially larger than the outer diameter of the flange piece 81 at the left. The sleeve 105 is formed to have a pair of slits 107, which are elongated along the axial direction of the sleeve 105 from the edge of the sleeve 105 to the left inner plate 25, in positions circumferentially spaced apart from each other. A smaller portion defined by the pair of slits 107 in the sleeve 105 serves to be a presser portion 108, which will be described below.

The presser portion 108 and the pair of slits 107 are set in a position between the vertical linear section 63 nearer to the front and the horizontal linear section 64 nearer to the top of the drum hole 32 of the left inner plate 25 when the left-side bearing 91 is held in the drum hole 32. In other words, when the left-side bearing 91 is held in the drum hole 32, the presser portion 108 opposes the curve section 61 between the vertical linear section 63 (i.e., the first edge) nearer to the rear and the horizontal linear section 64 (i.e., the second edge) nearer to the bottom. The presser portion 108 is formed to have a projection 109 at an edge on an inner circumference thereof.

In the present embodiment, a side, on which the presser portion 108 is formed, with respect to the flanged part 106, is referred to as a presser side of the left-side bearing 91. The presser side of the right-side bearing 90 mainly appears in FIG. 9.

The flanged part 106 is formed to have two stoppers 110, in positions to oppose to each other with the shaft 83 in between, on an outer rim thereof. Each of the stoppers 110 is formed to integrally have an extended portion 119 and a stopper projection 119.

The extended portion 119 extends outward from the outer rim of the flanged part 106 in a radial direction of the sleeve 105 and is formed to have a shape of rectangular in a side view. The stopper projection 120 is formed to protrude from an end of the extended portion 119 in the presser side of the left-side bearing 91. The extended portion 119 and the stopper projection 120 are in a shape of an L as a whole.

2.8 Installation of the Photosensitive Drums in the Drum Unit

Installation of the photosensitive drums 5 in the drum unit 3 will be described with reference to FIG. 3. The photosensitive drums 5 are installed in the drum unit 3, in which the four drum subunits 20, the front beam 21, the rear beam 22, and the pair of right and left inner plates 24, 25 is assembled.

In particular, the four drum subunits 20 are arranged with predetermined intervals therebetween. Thereafter, the front beam 21 is arranged in a position in front of the drum subunits 20 to be apart from the drum subunit 20 in the front. Further, the rear beam 22 is arranged in a position in rear of the drum subunits 20 to be slightly apart from the rearmost drum unit 20. Furthermore, the right inner plate 24 and the left inner plate 25 are arranged on the right side and the left side of the front beam 21, the drum subunits 20, and the rear beam 22, respectively. Thereafter, the right and left inner plates 24, 25 are fixed to the front beam 21, the four drum subunits 20, and the rear beam 22 by screws (not shown).

Next, the photosensitive drums 5 are attached to the assembly of the front beam 21, the four drum subunits 20, and the rear beam 22. In particular, the right-side bearing 90 is attached to a right-side end of the photosensitive drum 5. That is, the flange piece 81 for the right-side end is inserted inside the sleeve 92 of the right-side bearing 90. In this regard, the projection 97 in the presser portion 96 of the sleeve 92 becomes resiliently in contact with the outer edge of the flange piece 81. Therefore, the flange piece 81 is pressed in a direction to be away from the presser portion 96 (see FIG. 13). With the projection 97 of the right-side bearing 90 being in contact with the flange piece 81, and with the right-side bearing 90 externally attached to the flange piece 81, the shaft 83 held in the shaft holder 93 of the right-side bearing 90 is inserted in the photosensitive drum 5.

Next, the photosensitive drum 5 with the right-side bearing 90 on the right-side end thereof is attached to the drum hole 32 formed in the right inner plate 24. In particular, the photosensitive drum 5 is arranged in a position to have the right-side bearing 90 to oppose the drum hole 32 on its left. Thereafter, the photosensitive drum 5 is moved toward the right so that the right-side bearing 90 is inserted in the drum hole 32 with the outer periphery of the sleeve 92 being in contact with the four linear sections 60 of the drum hole 32. In this regard, the angled planes 118 in the stoppers 101 become in contact with the upper edge (i.e., the engageable portion 72) and the lower edge (i.e., the bearing engaging groove 70) of the right inner plate 24 approaching from the left. When the right-side bearing 90 is further moved to the right, the upper edge and the lower edge of the right inner plate 24 slide along the angled planes 118, and accordingly, the stopper projections 117 are resiliently deformed outward. Thus, the stopper projections 117 override the upper and lower edges of the right inner plate 24. When the flanged part 94 of the right-side bearing 90 comes in contact with the left-side plane of the right inner plate 24, the right-side bearing 90 is restricted from being moved furthermore to the right, and the deformed stopper projections 117 are released to recover to their original shapes. Accordingly, the right inner plate 24 is settled in between the angled planes 118 and the flanged part 94 of the right-side bearing 90, and the stoppers 101 are engaged with the engageable portion 72 and the bearing engaging groove 70 formed in the right inner plate 24.

When the right-side bearing 90 is thus attached to the right inner plate 24, clearance is created between the outer periphery of the sleeve 92 and the curve sections 61. With the right-side bearing 90 inserted in the drum hole 32, the presser portion 96 is set in the position between the vertical linear section 63 nearer to the front and the horizontal linear section 64 nearer to the top; therefore, the flange piece 81 is pressed toward the section between the vertical linear portion 63 nearer to the rear (i.e., the first edge) and the horizontal linear portion 64 nearer to the bottom (i.e., the second edge). Meanwhile, the outer periphery of the sleeve 92 of the right-side bearing 90 is fixed to be in contact with the four linear sections 60. Accordingly, the flange piece 81 is set in a position with respect to the first edge and the second edge with the outer periphery thereof being in contact with the inner periphery of the sleeve 92 of the right-side bearing 90. Thus, the right-side end of the photosensitive drum 5 is set in a correct position with respect to the right inner plate 24.

Next, the left-side bearing 91 is attached to the left inner plate 25 and to the left-side end of the photosensitive drum 5, specifically to the flange piece 81 for the left-side end. That is, with the flange piece 81 inserted in the drum hole 32 of the left inner plate 25, the sleeve 105 of the left-side bearing 91 is inserted in clearance between the outer periphery of the left-side flange piece 81 and the edge of drum hole 32. In this regard, the projection 109 in the presser portion 108 of the sleeve 105 becomes resiliently in contact with the outer edge of the flange piece 81. Therefore, the flange piece 81 is pressed in a direction to be away from the presser portion 108 (see FIG. 13).

Further, similarly to the right-side bearing 90 held in the drum hole 32, when the left-side bearing 91 is attached to the left inner plate 25 with the outer periphery of the sleeve 105 being in contact with the four linear sections 60 of the drum hole 32, clearance is created between the outer periphery of the sleeve 105 and the curve sections 61. With the left-side bearing 91 inserted in the drum hole 32, the presser portion 108 is set in the position between the vertical linear section 63 nearer to the front and the horizontal linear section 64 nearer to the top; therefore, the flange piece 81 is pressed toward the section between the vertical linear portion 63 nearer to the rear (i.e., the first edge) and the horizontal linear portion 64 nearer to the bottom (i.e., the second edge). Meanwhile, the outer periphery of the sleeve 92 of the right-side bearing 90 is fixed to be in contact with the four linear sections 60. Accordingly, the flange piece 81 is set in a position with respect to the first edge and the second edge with the outer periphery thereof being in contact with the inner periphery of the sleeve 105 of the left-side bearing 91. Thus, the left-side end of the photosensitive drum 5 is set in a correct position with respect to the left inner plate 25.

When the left-side bearing 91 is completely settled in the drum hole 32, the flanged part 106 of the left-side bearing 91 is in contact with the left-side plane (i.e., the outer plane) of the left inner plate 25. Therefore, the left-side bearing 91 is restricted from being moved further more to the right. Accordingly, a position of the left-side bearing 91 in the widthwise direction is determined. Further, the stopper projection 120 on the upper side is fitted to the engageable portion 72 of the left inner plate 25 at, and the stopper projection 120 on the lower side is fitted to the bearing engaging groove 70 of the left inner plate 25. Thus, the stopper projections 110 are engaged with the engageable portion 72 and the bearing engaging groove 70 formed in the left inner plate 25 so that the position of the left-side bearing 91 in the widthwise direction is secured.

Figure 6:
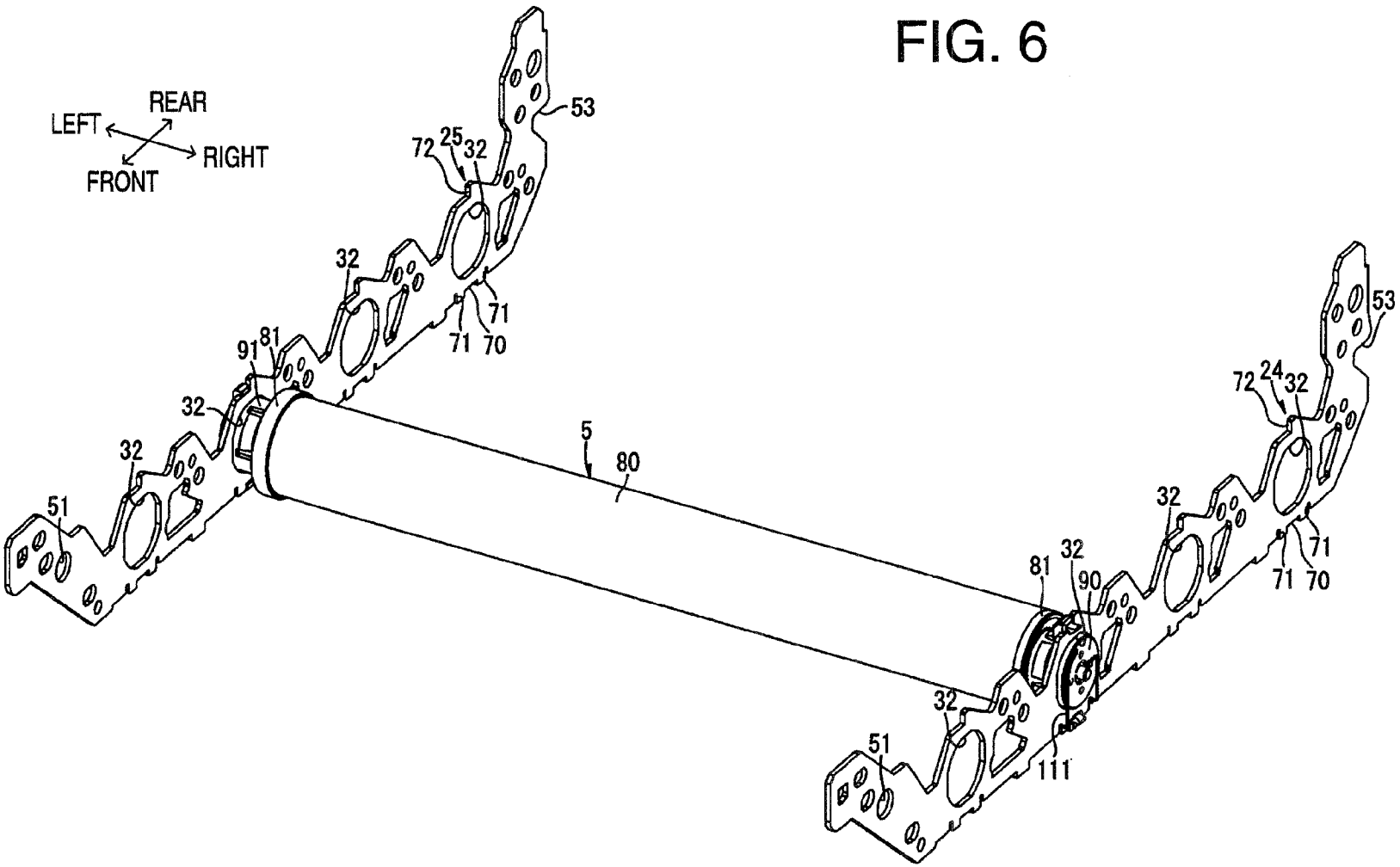
FIG. 6 is a perspective view of a photosensitive drum set in a right inner plate and the left inner plate according to the embodiment of the present invention.

Thereafter, as shown in FIG. 6, a clipper 111 is attached to a part of the shaft 83 protruding out from the closure portion 98 (see FIG. 8) of the right-side bearing 90 further toward right. The clipper 111 is a three-sided box-shaped piece of clamp, of which free ends are bended to be hooked in the clipper-holding grooves 71 of the right inner plate 24. Installation of the photosensitive drum 5 is completed.

When the four photosensitive drums 5 are installed, the right and left outer plates 27, 28 are arranged on the outer sides of the right and left inner plates 24, 25 respectively. The right and left outer plates 27 are fixed to the right and left inner plates 24, 25, the front beam, the four drum subunits 20, and the rear beam 22 by screws (not shown). Thus, the assembly of the drum unit 3 is completed.

2.9 Installation of the Developer Cartridge in the Drum Units

Figure 13:
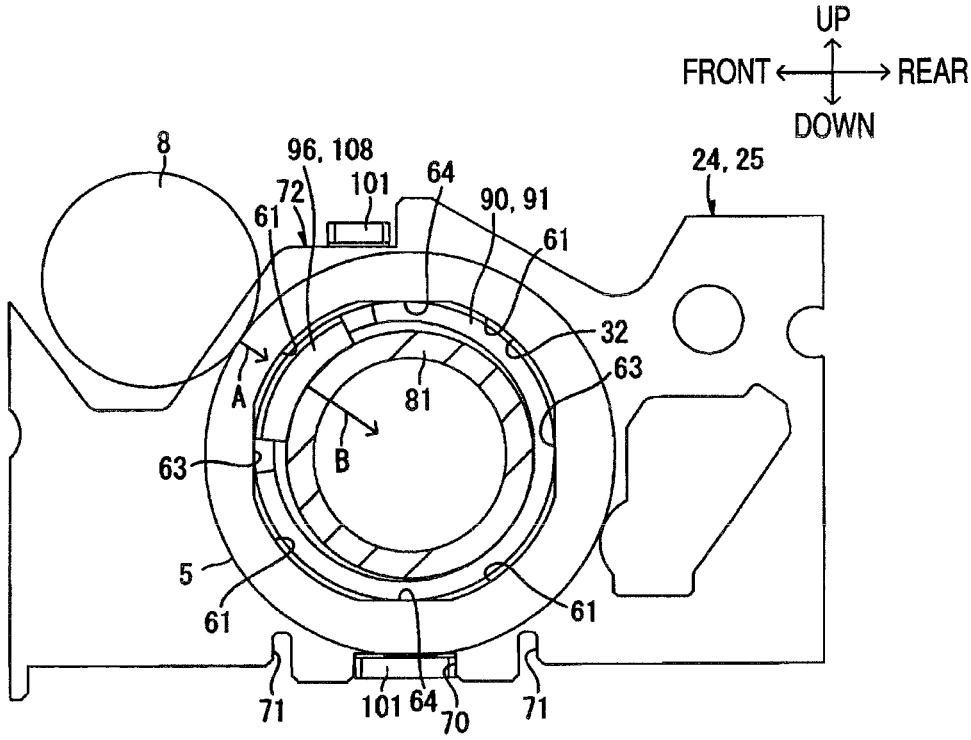
FIG. 13 is an illustrative side view of a developer roller and the photosensitive drum in the developer cartridge installed in the drum unit according to the embodiment of the present invention.

Installation of the developer cartridges 7 in the drum units 3 will be described with reference to FIGS. 2 and 13. The developer cartridges 7, each of which corresponds to one of the CMYK colors, are installed in the assembled drum unit 3. Each of the right and left outer plates 27, 28 is formed to have four guide grooves 113 in inner surface thereof. The guide groove 113 is a protrusive rail extending from the upper edge of the right (or left) outer plate 27 (28) toward the position of the photosensitive drum 5, and makes a pair with the guide groove 113 formed in the opposing left (or right) outer plate 28 (27). The developer cartridge 7 is inserted in the guide grooves 113 and guided downward along the pair of guide grooves 113 to be installed in a correct position in the drum unit 3.

When the developer cartridge 7 is inserted in the guide grooves 113 and in a position immediately before the correct position, a direction, in which the developer cartridge 7 proceeds, corresponds to a direction B (see FIG. 13), in which the flange pieces 81 are pressed by the presser portions 96, 108 of the right and left-side bearings 90, 91. Accordingly, a direction A (see FIG. 13), in which a periphery of a developer roller 8 in the developer cartridge 7 approaches to become in contact with the periphery of the photosensitive drum 5, coincides with the direction B.

3. Grounding the Photosensitive Drum

The photosensitive drum 5 is provided with a grounding member (not shown) at the right-side end of the cylinder 80. The grounding member is formed to have a shape of a disk, which is arranged to be orthogonally to an axis of the cylinder 80 so that a diameter of the disk becomes in contact with an inner periphery of the cylinder 80.

When the right-side bearing 90 is completely attached to the right-side flange piece 81, the shaft 83 in the right-side bearing 90 is inserted inside the photosensitive drum 5 and becomes in contact with the grounding member. Accordingly, the photosensitive drum 5 and the shaft 83 are electrically connected. Further, as shown in FIG. 6, the shaft 83 is connected with the clipper 111 at its right-side end, and the free ends of the clipper 111 are hooked in the clipper-holding grooves 71 in the metal right inner plate 24. Thus, the shaft 83 and the right inner plate 24 are electrically connected. Therefore, the cylinder 80 in the photosensitive drum 5 is electrically conducted with the right inner plate 24 via the grounding member, the shaft 83, and the clipper 111.

When the drum unit 3 is installed in the casing 2, as shown in FIG. 1, the cutouts 53 (see FIG. 4) in the right and left inner plates 24, 25 receive the reference shaft 34 so that the right and left inner plates 24, 25 are grounded via the reference shaft 34. Further, due to the electrical connection of the photosensitive drum 5 with the right inner plate 24 via the grounding member, the shaft 83, and the clipper 111, the photosensitive drum 5 is grounded through the grounding member, the shaft 83, the clipper 111, the right inner plate 24, and the reference shaft 34.

4. Casing 4.1 Attachment and Removal of the Drum Unit

Attachment and removal of the drum unit 3 to and from the casing 2 will be described with reference to FIG. 1. When the drum unit 3 is attached to the casing 2, first of all, the front cover 4 of the casing 2 is moved to expose the opening (not shown). The drum unit 3 is inserted in the casing 2 through the opening and moved toward the rear. The drum unit 3 is guided toward the rear, and when the cutouts 53 (see FIG. 4) formed in the right and left inner plates 25 come in contact with the reference shaft 34, the drum unit 3 is restricted from being moved furthermore to the rear. The drum unit 3 is thus set in the casing 2.

When the drum unit 3 is removed from the casing 2, the drum unit 3 is moved in the opposite order from the above attaching procedure.

4.2 Input of Driving Force to the Photosensitive Drum

The driving forces to be transmitted to the photosensitive drums 3 will be described with reference to FIG. 2. In the casing 2 with the drum unit 3 attached thereto, drive force transmitters 112 are arranged in positions opposing the left-side ends of the photosensitive drums 5 in the widthwise direction. The drive force transmitters 112 are gears to transmit driving force to the photosensitive drums 5. After the drum unit 3 is attached to the casing 2, each of the drive force transmitters 112 moves toward the right to be connected to a connector groove (not shown) formed on the left-end surface of the flange piece 81. Accordingly, the driving force supplied to the drive force transmitters 112 is transmitted to the photosensitive drums 5 so that the photosensitive drums 5 are rotated.

When the drive force transmitters 112 are connected to the connector grooves formed on the left-end surfaces of the flange pieces 81, the drive force transmitters 112 are further moved toward the right so that the entire drum unit 3 is pushed to the right. Thereby the drum unit 3 is settled in a correct position in the widthwise direction in the casing 2.

5. Effectiveness of the Configuration

As has been described above, the right and left inner plate 24, 25 are formed to have the drum holes 32, of which circumference includes the first edge (i.e., the rear vertical linear section 63) and the second edge (i.e., the lower horizontal linear section 64) extending along different directions from each other. The photosensitive drums 5 are provided with the flange pieces 81 at each axial end thereof, and the right-side bearings 90 and the left-side bearings 91 are externally attached to the outer peripheries of the flange pieces 81. Further, the right and left-side bearings 90, 91 are inserted in the drum holes 32, and the flange pieces 81 are each pressed toward the section between the first edge and the second edge in the drum hole 32. Accordingly, the right-side flange piece 81 being in contact with the inner periphery of the right-side bearing 90 is set in the proper position with respect to the first edge and the second edge of the drum hole 32. Meanwhile, the left-side flange piece 81 being in contact with the inner periphery of the left-side bearing 91 is set in the proper position with respect to the first edge and the second edge of the drum hole 32. Thus, the flange pieces 81 are set in the proper positions in the up-down direction and the front-rear direction. Accordingly, the photosensitive drums 5 are set in proper positions with respect to the right and left inner plates 24, 25 with accuracy.

In the printer 1, the right and left-side flange pieces 81 are inserted in the right and left-side bearings 90, 91 respectively to have clearance from the inner peripheries of the sleeves 92, 108 of the right and left-side bearings 90, 91 respectively so that the flange pieces 81 are set in the positions by the pressure from the presser portions 96, 108. The clearance absorbs difference of dimensions between the right inner plate 24 and the left inner plate 25 caused by thermal expansion; therefore, parallel positions of the four photosensitive drums 5 can be maintained regardless of temperature of the environment surrounding the printer 1. Accordingly, misalignment of colored toners can be avoided.

According to the above embodiment, the presser portion 96 is integrally formed with the right-side bearing 90. Therefore, a quantity of pieces of components can be reduced compared to a bearing with a separately-formed presser member. Similarly, the presser portion 108 is integrally formed with the left-side bearing 91; therefore, a quantity of pieces of components can be reduced.

According to the above embodiment, the right-side bearing 90 is formed to have the sleeve 92, which protrudes from the right inner plate 24 toward the photosensitive drum 5. The sleeve 92 is formed to have a pair of slits 95, which are cutout-formed in the axial direction of the sleeve 92 from the edge of the sleeve 92, in the positions circumferentially spaced apart from each other. Further, the smaller portion defined by the pair of slits 95 in the sleeve 92 being the presser portion 96 is formed to have the projection 97 at the edge on the inner circumference thereof. Thereby, when the right-side flange piece 81 is inserted in the right-side bearing 90, the projection 97 becomes resiliently in contact with the right-side flange piece 81 and presses the flange piece 81 in the direction in which the projection 97 protrudes. Thus, the presser portion 96 to press the flange piece 81 is provided in the simple structure. Accordingly, manufacturing cost for the overall printer 1 can be reduced. Further, a quantity of pieces of components in the printer 1 can be reduced compared to a printer having bearings and separately-formed presser portions.

Moreover, the left-side bearing 91 is similarly formed to have the sleeve 105, the pair of slits 107 in the sleeve 105, the presser portion 108 defined by the slits 107, and the projection 109 to resiliently press the flange piece 81 in the direction in which the projection 109 protrudes. Thus, in the simple structure of the left-side bearing 91, manufacturing cost for the overall printer 1 can be reduced. Further, a quantity of pieces of components in the printer 1 can be reduced compared to a printer having bearings and separately-formed presser portions.

According to the above embodiment, the right-side bearing 90 is formed to have the annular flanged part 94, which is arranged along the right inner plate 24. In particular, the right-side bearing 90 is inserted in the drum hole 32 with the flanged part 94 arranged to be in contact with the inner plane (i.e., the left side) of the right inner plate 24. Thus, the right-side bearing 90 can be set in the correct position in the widthwise direction with respect to the right inner plate 24. Further, the flanged part 94 is formed integrally with the stoppers 101, which are engaged with the bearing engaging groove 70 and the engageable portion 72 formed in the right inner plate 24. Accordingly, the right-side bearing 90 is maintained in the correct position in the widthwise direction.

Moreover, the left-side bearing 91 is similarly formed to have the annular flanged part 106; therefore, the left-side bearing 91 can be set in the correct position in the widthwise direction with respect to the left inner plate 25. Further, the flanged part 106 is formed integrally with the stoppers 110, which are engaged with the bearing engaging groove 70 and the engageable portion 72 formed in the left inner plate 25. Accordingly, the left-side bearing 91 is maintained in the correct position in the widthwise direction.

According to the above embodiment, further, the drive force transmitters 112 are provided on the left side of the photosensitive drums 5 so that the drive force to rotate the photosensitive drums 5 is transmitted to the photosensitive drums 5.

The drum unit 3 includes the developer rollers 8, of which circumferences press the photosensitive drums 5. According to the above embodiment, the direction B (see FIG. 13) for the flange pieces 81 are pressed by the presser portions 96, 108, coincides with the direction A (see FIG. 13), in which the developer rollers 8 press the photosensitive drums 5. Therefore, the flange pieces 81 are subject to the pressure from the presser portions 96, 108 and the developer rollers 8. Accordingly, the flange pieces 81 are securely set in the correct positions with respect to the right inner plate 24 and the left inner plate 25.

6. Examples of Variation

Although an example of carrying out the invention has been described, those skilled in the art will appreciate that there are numerous variations and permutations of the bearing device, the drum unit, and the printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the image forming apparatus may not necessarily be the tandem-typed color printer, but may be a monochrome printer or a laser printer. Further, the present invention may not necessarily be applied to an image forming apparatus, but may be applied to other frame structures to hold a rotor via the bearings.

What is claimed is:

1. A bearing device to hold a rotor in an opening formed in a frame, wherein circumference of the opening is formed to have a first edge and a second edge, which linearly extend along different directions from each other, comprising:

a bearing member configured to be externally attached to the rotor and inserted in the opening; and a presser member configured to press the rotor toward a section between the first edge and the second edge, wherein the presser member is formed integrally with the bearing member.

2. The bearing device according to claim 1, wherein the bearing member includes a protruding part to protrude in a direction from the frame toward the rotor;

wherein the protruding part is formed to have a pair of slits, which are elongated along an axial direction of the protruding part from an edge of the protruding part toward the frame; and wherein the presser member is a portion defined by the slits and has a projection at an edge on an inner circumference thereof.

3. The bearing device according to claim 1, wherein the bearing member includes:

an annular flanged part; and a stopper, which is formed integrally with the flanged part, to be engaged with a predetermined section of the frame.

4. The bearing device according to claim 1, wherein the axial end portion of the rotor includes a first axial end portion and a second axial end portion, and:

the bearing device further comprises a gear to transmit driving force to the rotor in vicinity of the first axial end portion of the rotor.

5. The bearing device according to claim 1, wherein the rotor is a photosensitive drum.

6. A drum unit comprising:

a photosensitive drum;

a frame having an opening formed to have circumference including a first edge and a second edge, which linearly extend along different directions from each other;

a bearing member configured to be externally attached to the photosensitive drum and inserted in the opening; and a presser member configured to press the photosensitive drum toward a section between the first edge and the second edge, wherein the presser member is formed integrally with the bearing member.

7. The drum unit according to claim 6, wherein the bearing member includes a protruding part to protrude in a direction from the frame toward the photosensitive drum;

wherein the protruding part is formed to have a pair of slits, which are elongated along an axial direction of the protruding part from an edge of the protruding part toward the frame; and wherein the presser member is a portion defined by the slits and has a projection at an edge on an inner circumference thereof.

8. The drum unit according to claim 6, further comprising:

a developer roller, of which circumference is pressed to the photosensitive drum;

wherein a direction in which the presser member presses the photosensitive drum coincides with a direction in which the circumference of the developer roller is pressed to the photosensitive drum.

9. The drum unit according to claim 6, wherein the bearing member includes:

an annular flanged part; and a stopper, which is formed integrally with the flanged part, to be engaged with a predetermined section of the frame.

10. The drum unit according to claim 6, wherein the axial end portion of the photosensitive drum has a first axial end portion and a second axial end portion, and:

wherein the drum unit further comprises a gear to transmit driving force to the photosensitive drum in vicinity of the first axial end portion of the photosensitive drum.

11. The drum unit according to claim 6, comprising:

a number of the photosensitive drums, wherein the frame is formed to have an equivalent number of openings, the equivalent number being equal to the number of the photosensitive drums.

12. A bearing member, comprising:

an annular flanged part; and a cylinder part protruding from the flanged part in an orthogonal direction being orthogonal with respect to a radial direction of the flanged part, wherein a pair of slits are formed in the cylinder part in positions circumferentially spaced apart from each other, each of the slits being elongated from an open edge of the cylinder part toward the flanged part along an axial direction of the cylinder part; and wherein the cylinder part comprises a first rib, which is formed in a circumferentially intermediate position between the pair of slits, and a second rib, which extends along a greater circumferential length than a circumferential length of the first rib.

13. The bearing member according to claim 12, wherein the first rib comprises a projection, which is formed to project circumferentially inward from an edge thereof.

14. The bearing member according to claim 12, further comprising a stopper part protruding in the radial direction of the flanged part, wherein the stopper part comprises a first stopper extending in the radial direction of the flanged part, and a second stopper extending from the first stopper in the orthogonal direction.

15. The bearing member according to claim 12, further comprising a closure part configured to plug an axial end of the cylinder part; and a shaft penetrating the closure part.

16. A bearing member, comprising:

an annular flanged part; and a cylinder part protruding from the flanged part in a first direction perpendicular to a radial direction of the flanged part, the cylinder part comprising:

a first rib located between a first slit and a second slit, and having a first circumferential length, each of the first slit and the second slit extending in the first direction;

a second rib located between the first slit and the second slit, and having a second circumferential length greater than the first circumferential length of the first rib.

17. The bearing member according to claim 16, wherein the first rib comprises a projection, the projection projecting circumferentially inward from an edge of the first rib.

* * * * *